US006437298B1

(12) United States Patent
Mendieta

(10) Patent No.: US 6,437,298 B1
(45) Date of Patent: Aug. 20, 2002

(54) FLAT RESISTANCE FOR HEATING A COOKING PLATE

(75) Inventor: Jose Leturia Mendieta, Lekeitio (ES)

(73) Assignee: Eika, S. Coop, Etxbarria (ES)

( * ) Notice: Subject to any disclaimer, the term of this patent is extended or adjusted under 35 U.S.C. 154(b) by 0 days.

(21) Appl. No.: 10/054,767

(22) Filed: Jan. 22, 2002

(30) Foreign Application Priority Data

Feb. 2, 2001 (ES) ..... 0100245 U

(51) Int. Cl.[7] ..... H05B 3/68
(52) U.S. Cl. ..... 219/461.1
(58) Field of Search ..... 219/460.1, 461.1, 219/462.1, 467.1; 338/283, 284, 285, 286, 287, 288, 291

(56) References Cited

U.S. PATENT DOCUMENTS 4,161,648 A * 7/1979 Goessler ..... 219/461.1
5,796,075 A * 8/1998 Gross et al. ..... 214/448.19
5,834,740 A * 11/1998 Wilde et al. ..... 219/461.1
5,837,975 A * 11/1998 Dillard et al. ..... 219/448.19
6,201,220 B1 * 3/2001 Mendieta ..... 219/461.1

* cited by examiner

*Primary Examiner*—Sang Paik
(74) *Attorney, Agent, or Firm*—The Kline Law Firm

(57) ABSTRACT

The heating resistance (2) comprises a flat conductor strip of small thickness, made from a strip of high-temperature alloy, and extended over the porous insulating base (4) of a radiant electric cooking plate, which has a flat horizontal surface, and a series of lugs for welded on the strip insertion into the insulating base (4) to fix into a vertical position the heating resistance (2) without the need for seating grooves. The heating resistance (2) has a regular width (W) and the retaining lugs (3) are straight and flat, of a thickness "t2" greater than the thickness (t1) of the resistance strip (2) and of high inserted length (h2) in relation to the height (h1) of the strip (2).

2 Claims, 1 Drawing Sheet

FLAT RESISTANCE FOR HEATING A COOKING PLATE

TECHNICAL FIELD

The present invention relates to a heating resistance and to the means for securing it to the insulating support base of a radiant heater specially adapted for a glass ceramic hob.

PRIOR ART

Electric radiant heaters for glass ceramic hobs in which the heating resistance is made from a thin flat strip of high working temperature alloy, as described in EP-750444-A (U.S. Pat. No. 5,834,740), are already known. The resistance comprises a thin strip of the same width over its whole length, between 1.5 mm–7 mm, variable in accordance with the power, which is first shaped in undulating form and then set in place securely on the horizontal insulating base of the heater, supporting its edge. The resistance strip has its own integral fixing tabs protruding from one of the edges of the strip and spaced at a regular distance from one another, at considerable intervals of resistance length. The insulating base is made of a microporous heat-insulating material and the fixing tabs are inserted on it, so that the resistance strip is left in a vertical position.

The fixing tabs integral with the strip give rise to an irregular conductor section along the resistance, which produces differences in temperature that accelerate its thermal fatigue. The manufacture of a resistance strip with integrated tabs calls for a process of stamping of two simultaneous resistance strips from a double-width alloy, which must be high precision in order to achieve the same conductor section of the resistance strip over its whole length, as its power rating is determined afterwards by means of the length of strip only. Another drawback of the solutions with integral fixing tabs is that they require a change of die for stamping the resistance strips when a different distance between tabs is sought.

Heat dissipation by way of the fixing tabs has to be the minimum possible so as not to generate a cold area around the tab that alters the overall working temperature and produces thermal stress. A resistance strip for a radiant heater is very thin, with a thickness of 0.04 mm–0.15 mm, so the integral tab is also very thin. The integral tabs must be of low height to facilitate the stamping of the strip with dies, while at the same time of large area to achieve lasting anchorage of the resistance and to prevent its bending during insertion. The short fixing tabs call for a large number of tabs per section of length, as the interval between two successive tabs is a decisive factor for the resistance to remain in place on the insulating base throughout the life of the cooking plate.

Furthermore, in the solution shown in the aforementioned prior art document, the tab area is small, but the tab has to be curved in the form of a blade in order to improve anchorage, while the strip must necessarily be bent along the line of the tab during its undulating shaping. The simultaneous bending of the resistance strip and the tab adds a difficulty to the manufacture of the resistance.

SUMMARY OF THE INVENTION

The object of the invention is a flat electrical heating resistance for a radiant heater of a glass ceramic hob cooking plate, provided with a series of retaining lugs for its installation in a vertical position on the porous insulating base of the radiant heater, as defined in claim 1.

The present invention provides a system for fixing the heating resistance different from that of the solution described above in the prior art. The resistance strip has retaining lugs, welded on one of its sides at well spaced out intervals along the resistance in order to avoid cold areas on the resistance, while it is also sturdy and has a lug projecting from the lower edge that is relatively high but of small section, chosen in each case in accordance with the strip width.

The resistance strip is formed by cutting it out of an alloy band or ribbon of larger width in order to obtain several strips at the same time, so that the whole width of the band is utilised with no wastage of material. The cutting process is simple in comparison with the stamping of the band to obtain two strips with integrated tabs, as it is done in the prior art, and furthermore, compared with the integral tab strips, a resistance conductor section is obtained that is the same over its whole length. The thickness of the lug, greater than that of the resistance strip, may be chosen in each case so that the lug is resistant to bending regardless of the thickness of the resistance strip.

Through not needing stamping dies for the lugs, the heating resistance according to the present invention also offers the advantage of flexibility in the range of heating resistance power ratings. The lugs are welded onto the resistance strip prior to its undulation bending on an automatic machine that synchronises the positioning of the strip and lugs under the welding electrode. Thus, the length of the retaining lugs is the only variable in accordance with the radiant heater power, without the need to change, the strip or lug feed sequence on the welding machine.

DETAILED DESCRIPTION OF THE PREFERRED EMBODIMENT

Figure 1:
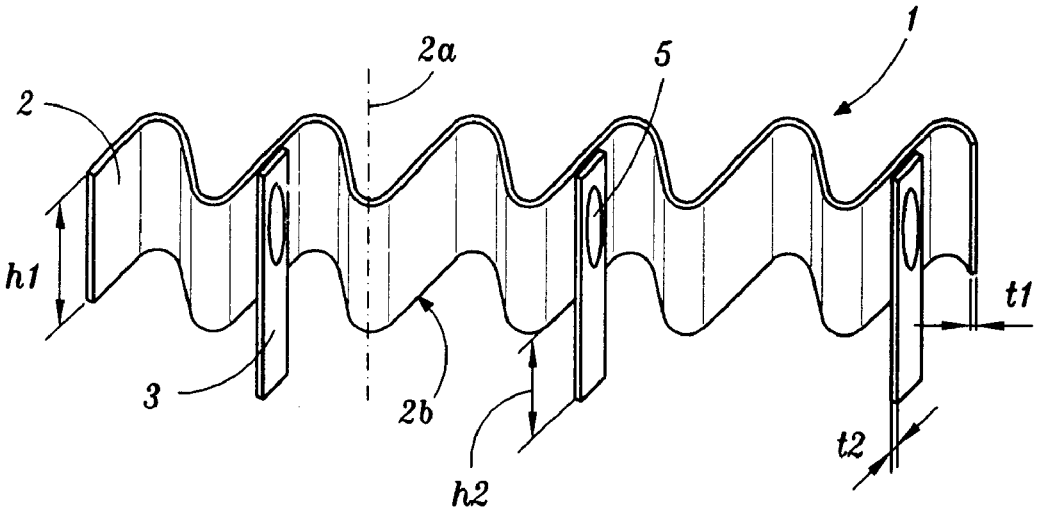
FIG. 1 is a partial perspective view of a heating resistance according to this invention, prior to fixing.
Figure 3:
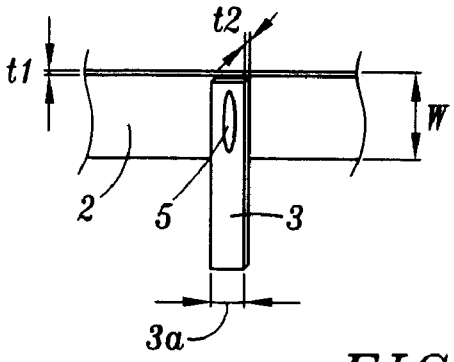
FIG. 3 is an enlarged close view of the heating resistance in FIG. 1.
Figure 2:
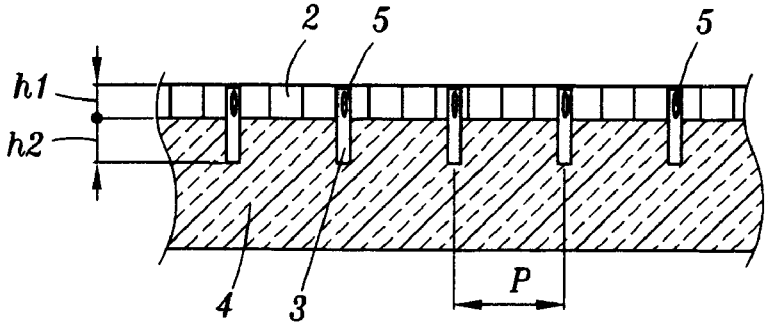
FIG. 2 is an elevational view of the resistance in FIG. 1 mounted on the insulating base of a cooking plate radiant heater.

An embodiment of the heating resistance according to the present invention is shown in FIGS. 1–3. It comprises a resistance strip of uniform width "W", thickness "t1" and indefinite length, made first of all from the cutting of a band of Fe Cr alloy or the like, and a series of straight flat lugs 3 of thickness "t2" and height "h2", obtained separately from another band of the same or similar alloy and welded to the resistance strip 2 at regular or irregular intervals "p" of length.

With reference to FIG. 2, heating resistance 1 is fitted in a vertical position on an insulating base 4 made of porous material of a radiant heater of a glass ceramic hob cooking plate by means of the insertion of the lugs 3 into the insulating base 4 until the strip edge 2*b* contacts the horizontal surface of the insulating base 4. This original width "W" of the strip 2 thus becomes a height "h1" of the resistance above said horizontal surface.

With reference to FIG. 3, in an operation prior to the installation of the heating resistance, the series of straight flat lugs 3 is welded onto one side of the strip with a LASER or electric spot-weld 5, although there could also be two spot-welds 5 due to the long portion of overlapping lug 3. In a subsequent operation (FIG. 1) the resistance strip 2 is bent so that it takes on an undulating or zig-zag configuration on transverse lines (2*a*) not coinciding with the lugs 3, which are always flat. Finally, the heating resistance is press-fitted (FIG. 2) onto the insulating base of the cooking plate until the edge 2*b* of the strip comes up against the surface of the insulating base 4, with the result that the resistance 1 is secured in the vertical position without any need for seating grooves on this surface.

The resistance strip 2 has a thickness "t1", 0.04 mm–0.15 mm, and a width "W", 1.3 mm–6 mm, variable in accordance with the heating power, so it is highly sensitive to the mechanical stress applied during its mounting. The retaining lugs 3 have a thickness "t2", 0.06 mm–0.25 mm, that means greater than the thickness "t1" of the strip 2, and the lug width 3*a,* 0.8 mm–2.5 mm. The lowest values of lug thickness "t2" correspond to the highest lug width 3*a* value, because a lug 3 both thin and narrow, would bend during insertion of the resistance in the insulating base 4. Lugs 3 with a thickness "t2" of 0.08–0.2 mm and a width 3*a* of around 1–2 mm are preferable. In this way, lug strength, a small heat dissipation area, and a smaller number of cold areas along the length of the strip 2 are all successfully achieved. The series of lugs 3 are welded to the strip on an automatic machine at broadly spaced intervals "p" of resistance length, such as for instance "p"=40–50 mm, as this is made possible by the considerable height "h2" of lug 3, which protrudes 3–6 mm, depending on the width "W" of the strip 2, and is inserted. The interval "p" of resistance length between two successive lugs 3 is predetermined so that with the undulation of the strip, there are six or eight wave-like bends between two successive lugs 3.

What is claimed is:

1. Flat heating resistance fitted in a radiant heater of a glass ceramic hob cooking plate comprising, a horizontal surface insulating base in the radiant heater, on which the flat heating resistance is fixed a flat elongated resistance strip of a thickness between 0.04–0.15 mm and a uniform width between 1.3 mm–6 mm, configured along the resistance by means of wave-shaped bending, a set of metal retaining lugs for fixing the heating resistance, spaced out along the resistance strip at given intervals apart from one another and inserted in said insulating base for fixing the resistance, wherein the retaining lugs are straight and flat, of a thickness greater than that of the resistance strip, and have the thickness between 0.06 mm–0.25 mm and a width between 0.8 mm–2.5 mm, and the retaining lugs are joined on the resistance strip by means of one weld each one placed between two of said strip bends, keeping the resistance strip fixed in a vertical position projecting from the surface of the insulating base at a height equivalent to the said strip width, with no need for locating grooves in the insulating base.

2. Flat heating resistance according to claim 1, wherein said retaining lugs are made of electrical resistance alloy of a thickness between 0.08–0.2 mm, of a width between 1.0 mm–2 mm, and a lug height protruding from the resistance strip prior to being inserted in the insulating base of 3–6 mm, depending on said strip width.

* * * * *